United States Patent [19]

Maudlin

[11] 3,943,728

[45] Mar. 16, 1976

[54] AIR-COOLED CONDENSER APPARATUS

[75] Inventor: Wendell E. Maudlin, York, Pa.

[73] Assignee: Borg-Warner Corporation, Chicago, Ill.

[22] Filed: Mar. 7, 1975

[21] Appl. No.: 556,246

Related U.S. Application Data

[63] Continuation of Ser. No. 430,295, Jan. 2, 1974, abandoned.

[52] U.S. Cl. ..... 62/507; 62/426; 165/127

[51] Int. Cl.[2] ..... F25B 39/04

[58] Field of Search ..... 165/121–125; 123/41–49; 62/426, 507, 508

[56] References Cited

UNITED STATES PATENTS

| | | | |
|---|---|---|---|
| 632,507 | 9/1899 | Allington | 165/125 |
| 1,887,563 | 11/1932 | Neal | 62/507 |
| 2,153,120 | 4/1939 | Ludlow et al. | 165/125 |
| 2,175,914 | 10/1939 | Philipp | 62/508 |
| 2,368,392 | 1/1945 | Young | 165/125 |
| 2,478,137 | 8/1949 | Timmer | 62/508 |
| 2,789,647 | 4/1957 | Couse | 165/121 |
| 2,959,035 | 11/1960 | Payton | 62/426 |
| 2,963,882 | 12/1960 | Malkoff et al. | 62/426 |
| 2,995,906 | 8/1961 | Brandimarte | 165/124 X |
| 3,638,445 | 2/1972 | Lavigne, Jr. | 165/121 |

*Primary Examiner*—Charles J. Myhre
*Assistant Examiner*—Theophil W. Streule, Jr.
*Attorney, Agent, or Firm*—Thomas B. Hunter

[57] ABSTRACT

Condenser apparatus for use in air-conditioning and refrigeration systems and comprising a compressor, fan motor, fans and an enclosure having three sides provided by an inverted U-shaped condenser coil unit with its spaced end walls being provided with venturi-defining passages receiving fans which are operative to draw outside air through the passages into the enclosure and to discharge the air through the condenser coil unit.

1 Claim, 6 Drawing Figures

FIG.3
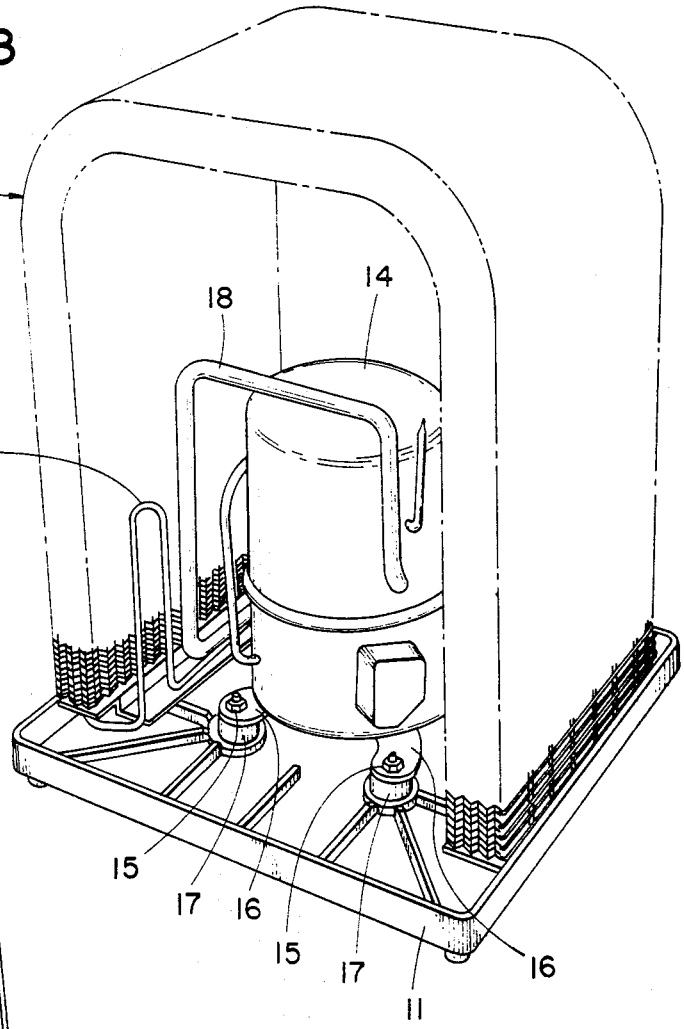
FIG.4
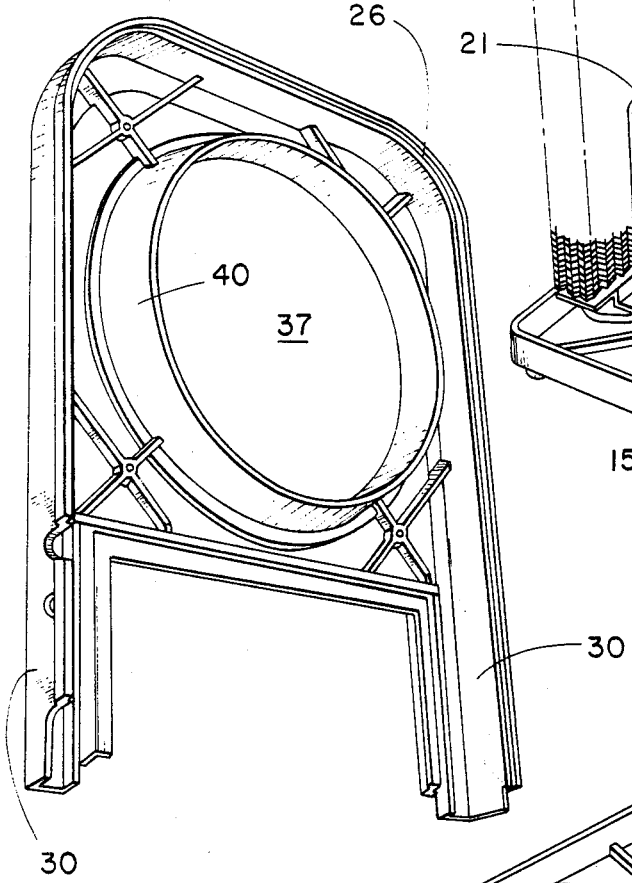
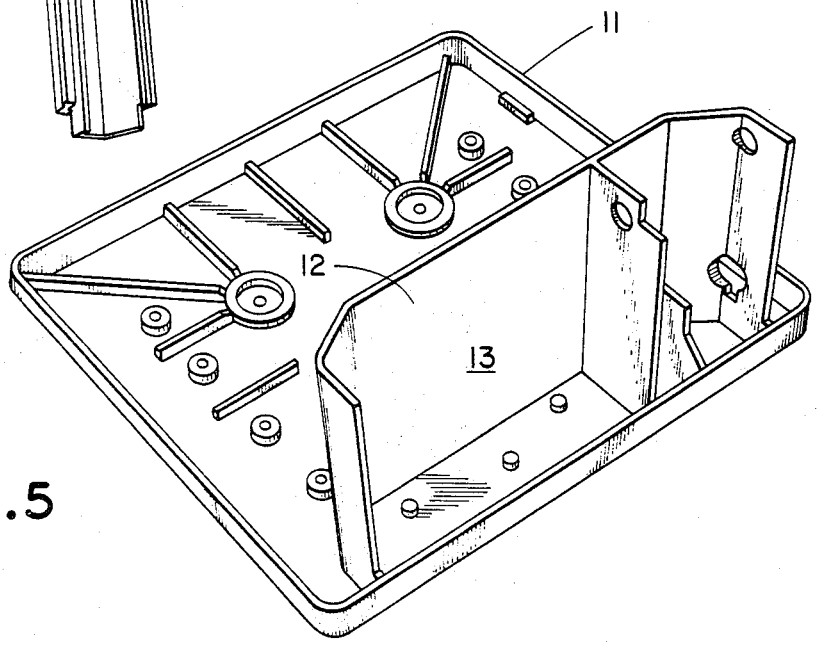
FIG.5

AIR-COOLED CONDENSER APPARATUS

This is a continuation of application Ser. No. 430,295 filed Jan. 2, 1974, now abandoned.

BACKGROUND AND SUMMARY OF THE INVENTION

This invention relates to air-cooled condenser apparatus for air-conditioning and refrigeration systems.

Conventional air-cooled condenser apparatus now in general use employ a condenser coil and a single fan propeller located in an enclosure or a duct, having an inlet and an outlet communicating with the outside air space. The propeller fan provides for axial flow of outside air through the enclosure or duct and over the coil at substantially high velocity, resulting in considerable air turbulence and noise.

The air-cooled condenser apparatus of the present invention is characterized by the provision of an enclosure for a fan motor and fans and includes a condenser unit of an inverted U-shape forming the sides of the enclosure with the front and rear end walls of the enclosure being provided with venturi-defining passages receiving fans drawing outside air through the passages into the enclosure and to discharge the air through the condenser coil unit. The fans, in combination with the venturi passages and enclosure structure including the coil unit, act similar to centrifugal blower, providing improved air-moving performance compared to the conventional axial flow fan propeller.

The air-cooled condenser apparatus of the present invention has further advantages over conventional apparatus in that the use of two fans instead of one permits greater venturi area with resultant lower air velocity; the fan blade tip speed is lower; the air discharge pattern from the fan blades matches the required air flow pattern, all of which features minimize air turbulence and noise. Moreover, it results in lower air turbulence and lower pressure losses due to larger condenser area; and the use of a more efficient blower effectively reduces air-moving power requirements.

DESCRIPTION OF THE DRAWING

FIG. 3 is a perspective view of the condenser coil unit and compressor of the apparatus;

FIG. 4 is a perspective view of one of the identical frame members shown in FIGS. 1 and 2;

FIG. 5 is a perspective view of the base plate shown in FIGS. 1 and 2; and

DESCRIPTION OF THE PREFERRED EMBODIMENT

Figure 1:
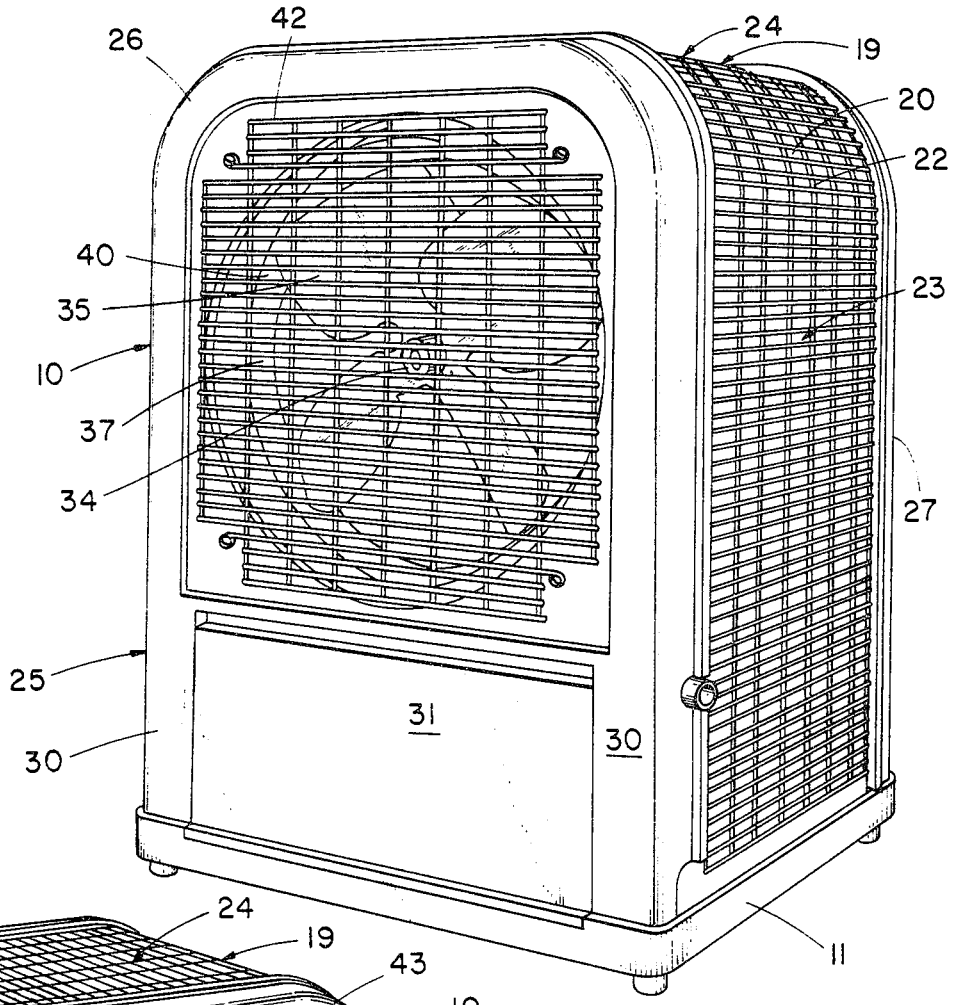
FIG. 1 is a front perspective view of condenser apparatus illustrating a preferred embodiment of the invention.

Referring to the drawings, the improved condenser apparatus constitutes the high pressure side of a "split" refrigeration system and comprises an enclosure in the form of a casing or housing 10 including a base or mounting plate 11 having a partition 12 (FIG. 5) providing a compartment 13 for electrical controls for the refrigeration system. A compressor 14 is mounted on the plate 11 by a plurality of bolts 15 extending through compressor feet 16 and rubber vibration isolator pads

17 and threaded into the base plate 11. A hot gas line or conduit 18 connects the discharge of the compressor 14 with a condenser unit 19. The refrigerant liquified in condenser unit 19 flows through hot liquid line 21 to an expansion device and evaporator (not shown).

The condenser unit 19 is generally the shape of an inverted "U" and comprises a heat transfer coil 20 in the form of a tubular member bent back and forth upon itself to provide a coil which is of serpentine shape. The coil is provided with a series of thin sheet metal fins 22 mounted on the coil and spaced apart along the coil in planes substantially perpendicular to the coil.

Figure 2:
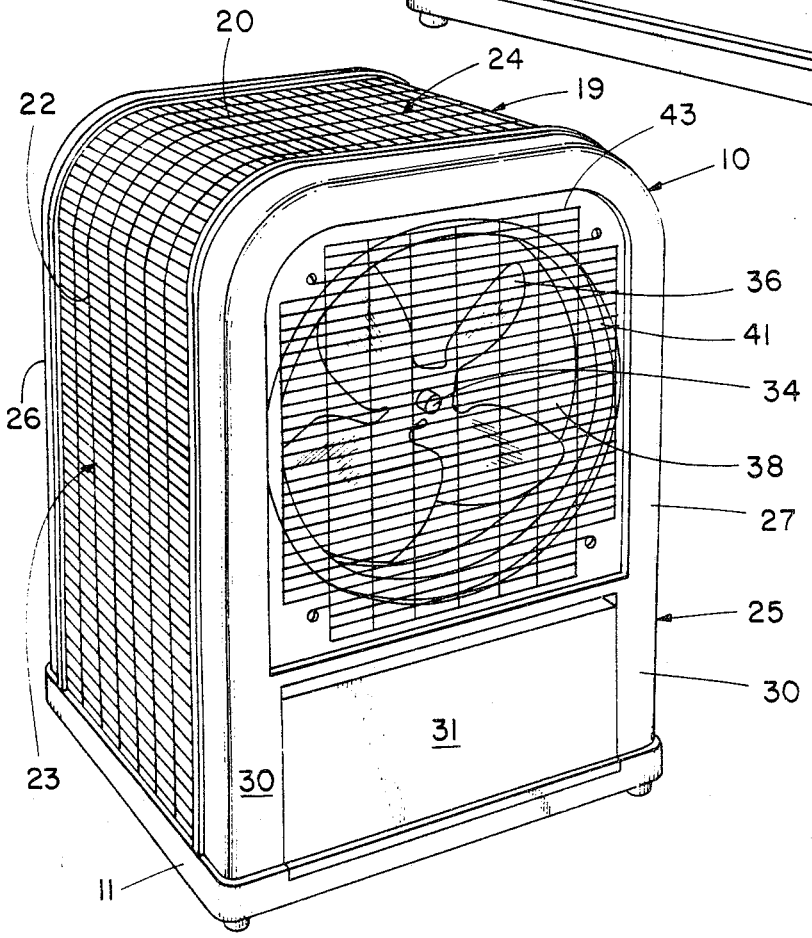
FIG. 2 is a rear perspective view of the condenser apparatus shown in FIG. 1.

As seen in FIGS. 1, 2 and 3, the inverted U-shaped condenser unit 19 provides three sides 23, 24 and 25 of the enclosure 10 with the parallel sides 23 and 25 having their lower ends secured to the base plate 11. The enclosure also includes two substantially identical frame members 26 and 27 providing front and rear walls and which are coextensive with, and respectively engage, the opposite open ends 28 and 29 of the condenser unit. Each frame member has spaced legs 30 with their lower square ends fitting and engaging the rimmed corners of the base plate 11 and secured thereto. The frame members 26 and 27 are held in assembly with the condenser unit by bolts or other suitable means extending through the unit and connecting the same together. The frame members, including the legs, and base plate 11 define access openings to the compartment 13 and interior of the enclosure, the openings being closed by access plates 31 detachably connected to the frame members.

Figure 6:
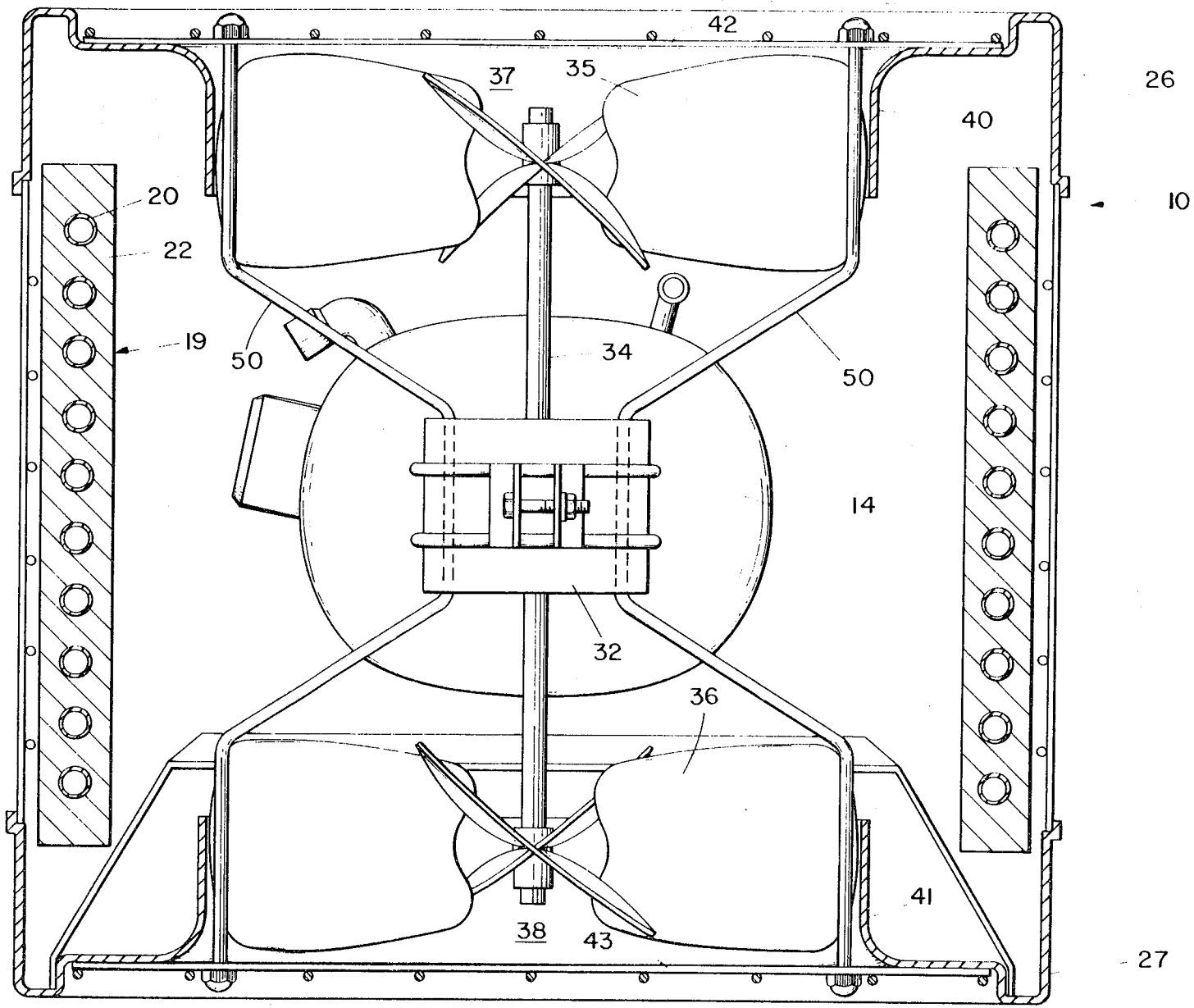
FIG. 6 is a cross-sectional view taken along the plane of line 6—6 of FIG. 1.

An electric motor 32 is disposed within the condenser coil unit and is mounted in the housing in a conventional manner, such as spaced spider arms 50 (FIG. 6) connected to and extending from the housing to the motor for the purpose of supporting the motor in its operating position. The motor armature shaft 34 has its projecting opposite ends connected to fans 35 and 36. The fans are located within circular openings 37 and 38 in the frame members 26 and 27 and their blades are formed to draw outside air through the openings and into the interior of the enclosure and forcibly discharge the air through the finned coil 20 (forming the three sides of the condenser coil unit) and from the enclosure. Flared annular portions 40 and 41 of the frame members define the openings 37 and 38 and are shaped to provide venturi relationships with the fans. Protective grilles 42 and 43 are connected to the frame members and cover the openings 37 and 38.

In operation, the fans 35 and 36 draw outside air through the openings 37 and 38 of the frame members into the enclosure 10 and discharge the air through the heat transfer condenser unit 19 to the exterior of the enclosure. The fans, in combination with the venturis 40 and 41, the enclosure 10, and coil 20, have performance characteristics similar to a centrifugal blower, providing improved air-moving performance compared to the axial flow propeller assemblies commonly used in condenser unit applications. The use of two fans provides greater venturi area and, accordingly, lower air velocity over the customary single fan of conventional condenser units. Also, the blade tip speed is lower. Since the air discharge pattern from the blades of the fans matches the required air flow pattern, air turbulence and noise are minimized. In addition, fan motor power can be low, as low air turbulence, low pressure losses due to large condenser area, and a more efficient blower combine to reduce air-moving power requirements. A desirable air discharge pattern is provided in the location of the condenser apparatus, in an air-conditioning application exteriorly of a building, because the low velocity warm air is distributed over a large area reducing the drying effect on plants or shrubs. The condenser coil unit is self-cleaning as rainwater washing the condenser, or an occasional dousing with a garden hose provides condenser coil cleaning in reverse direction to the air flow thereby most efficiently removing the surface dirt loading on the coil. Also, the highly-located air-intake minimize the entry of grass, leaves, etc. into the unit.

While this invention has been described with respect to a certain specific embodiment thereof, it should be understood that this is by way of illustration and not by way of limitation.

The invention should be considered within the spirit and scope of the appended claims which should be construed as broadly as the prior art will permit.

What is claimed is:

1. A condenser - compressor unit comprising: a base member; a refrigerant compressor mounted in the central portion of said base member; an inverted, generally U-shaped heat exchange coil having a pair of generally vertically disposed leg portions and an upper connecting portion, the bottom of said leg portions being secured to said base member on opposite sides thereof with the upper connecting portion extending over said refrigerant compressor and forming a pair of open sides; a pair of oppositely disposed end panels closing the open sides of said coil member and being provided with a central opening formed with a venturi entrance; a pair of fans adjacent said openings mounted on a common drive shaft; and a motor for driving said fans to induce air flow through said venturi entrances into the space defined between said end panels, said leg portions, and said upper connecting portion, whereby air is caused to flow through substantially the entire surface of said heat exchange coil.

* * * * *